US005195738A

United States Patent [19]

Gysling

[11] Patent Number: 5,195,738

[45] Date of Patent: Mar. 23, 1993

[54] SINGLE SHEET PICKING AND TRANSPORT MECHANISM

[75] Inventor: Walter Gysling, Excelsior, Minn.

[73] Assignee: National Computer Systems, Inc., Minneapolis, Minn.

[21] Appl. No.: 674,317

[22] Filed: Mar. 25, 1991

Related U.S. Application Data

[63] Continuation of Ser. No. 374,256, Jun. 30, 1989, abandoned.

[51] Int. Cl.[5] ..... B65H 3/06

[52] U.S. Cl. ..... 271/111; 271/34; 271/121; 271/261

[58] Field of Search ..... 271/34, 124, 121, 110, 271/111, 261, 263

[56] References Cited

U.S. PATENT DOCUMENTS

| | | | |
|---|---|---|---|
| 467,128 | 1/1892 | Brunet et al. . | |
| 825,476 | 7/1906 | Osborn . | |
| 1,052,257 | 2/1913 | Kemper . | |
| 2,104,630 | 1/1938 | Zahn . | |
| 2,214,752 | 9/1940 | Pierce . | |
| 2,224,137 | 12/1940 | Breman et al. . | |
| 2,836,416 | 5/1958 | Van Marle . | |
| 2,992,820 | 7/1961 | Tarbuck et al. . | |
| 3,029,074 | 4/1962 | Springer et al. . | |
| 3,044,770 | 7/1962 | Breuers . | |
| 3,260,521 | 7/1966 | Moxness . | |
| 3,272,500 | 9/1966 | Van Dalen et al. . | |
| 3,583,696 | 6/1971 | Runzi . | |
| 3,655,183 | 4/1972 | Wagner . | |
| 3,768,803 | 10/1973 | Stange . | |
| 3,957,366 | 5/1976 | Taylor et al. . | |
| 4,008,891 | 2/1977 | Buys . | |
| 4,034,976 | 7/1977 | Lundblad . | |
| 4,097,041 | 6/1978 | Fujimoto . | |
| 4,158,456 | 6/1979 | Holland-Letz . | |
| 4,193,590 | 3/1980 | Mangagnino . | |
| 4,268,027 | 5/1981 | Oleksiak et al. . | |
| 4,273,323 | 6/1981 | Kaneko et al. . | |
| 4,319,741 | 3/1982 | Okamoto | 271/118 |
| 4,346,879 | 8/1982 | Ruenzi . | |
| 4,378,109 | 3/1983 | Takahashi . | |
| 4,461,466 | 7/1984 | Uchida et al. . | |
| 4,548,397 | 10/1985 | Runzi . | |

FOREIGN PATENT DOCUMENTS

| | | | |
|---|---|---|---|
| 2545820 | 4/1976 | Fed. Rep. of Germany . | |
| 2305709 | 4/1980 | Fed. Rep. of Germany . | |
| 2940631 | 4/1981 | Fed. Rep. of Germany . | |
| 2424212 | 1/1979 | France . | |
| 229735 | 10/1986 | Japan | 271/121 |
| 515126 | 12/1971 | Switzerland . | |

*Primary Examiner*—Richard A. Schacher
*Attorney, Agent, or Firm*—Dorsey & Whitney

[57] ABSTRACT

An apparatus for removing a sheet from the top of a stack of sheets and transporting it laterally in the direction of a processing station has a pick roller with an arcuate contact surface for frictionally engaging an exposed edge of the top sheet in a stack. The arcuate contact surface transports the sheet laterally at a small downward angle relative to the plane of the top of the stack. The arcuate contact surface contacts the exposed edge so that portions of the arcuate contact surface adjacent the edge extend both above and below the plane of the top of the stack. A dam is located adajcent but spaced from the arcuate contact surface and below the plane of the top of the stack. The dam slidingly engages the sheet edge and the sheet surface opposite the surface engaged by the arcuate contact surface to guide the sheet edge toward the arcuate contact surface. A retard pad is mounted downstream from the dam so as to receive the edge of sheets guided by the dam and pinch the sheets between the retard pad and the arcuate contact surface.

19 Claims, 11 Drawing Sheets

| Fig. 3a | Fig. 3b | Fig. 3c |
|---|---|---|

| Fig. 4c |
| --- |
| Fig. 4b |
| Fig. 4a |

SINGLE SHEET PICKING AND TRANSPORT MECHANISM

This is a continuation of application Ser. No. 07/374,256 filed Jun. 30, 1989, now abandoned.

BACKGROUND OF THE INVENTION

1. Field of the Invention

The present invention relates generally to improvements in a device for handling stacked sheets of thin materials, such as sheets of paper. More particularly, the present invention relates to a high-speed mechanism for removing single sheets of paper from the top of a stack of sheets, where such sheets are transported for individual processing, such as by optical scanning, after being removed from the stack.

2. Description of the Prior Art

The use of rotating friction rollers or belts to "pick", that is to engage and remove laterally, the top sheet in a stack of sheets is known. A common problem with such mechanisms is that they do not always successfully pick a single sheet from the top of the stack, because the sheet below the top sheet tends to adhere to the lower surface of the top sheet and to follow the top sheet as it moves. In some circumstances, more than one sheet will follow the top sheet. If more than one sheet is removed from the stack, this can cause severe problems, particularly in machines that scan information contained on both sides of a sheet, e.g., a two-sided, optically scanned answer form. In higher speed machines that handle hundreds or thousands of documents in sheet form per hour, even occasional malfunctions of the sheet picking mechanism can lead to numerous errors or cause significant losses in throughput. Ordinarily, to avoid errors, immediate multiple-sheet detection must occur and operator intervention will be needed to remove multiple-picked documents and restore them to the document stack. If multiple-picked documents are not recognized, jams and/or misreading of documents can occur. The greater the picking and processing speed of the equipment, the greater the throughput loss when an operator must intervene.

Detection of multiple-picked sheets and mechanisms to correct multiple picking, such as reverse or stripping rollers, are known in the prior art. But such mechanisms are complex, less than perfectly reliable and only useful to correct the problem of a multiple pick once it has occured. The present invention recognizes that it is preferable to avoid multiple picking in the first place. Accordingly, it focusses on correcting the reasons why multiple picking occurs in conventional picking mechanism designs and proposes a novel picking mechanism that is intended to significantly reduce the likelihood of multiple sheet picks.

In particular, a study of the prior art reveals that in prior art sheet picking mechanisms the pick roller or pick belt rests on the top of the sheet stack with the top sheet in a tangent position relative to a curved surface of a pick roller or belt. To obtain adequate frictional force to draw the top sheet from the stack, the pick roller or belt exerts a normal force on the top sheet (perpendicular to the plane of the sheet), which is transmitted down through other sheets. Due to the resilience and flexibility of stacks of paper and the friction surface of the pick roller or belt, this normal force spreads to form a compression area around the line along which the pick roller or belt contacts the top sheet in a tangent relationship. This spreading creates an area of friction force between the top sheet and the sheet next below. Similar between-sheet forces extend further into the stack, lessening with distance from the top sheet. It is this between-sheet frictional force area that causes sheets below the top sheet to tend to follow the top sheet when it is drawn laterally from the sheet stack.

SUMMARY OF THE INVENTION

In the present invention the picking means is placed so that the frictional forces between the top sheet and the sheet next below (as well as between other adjacent sheets in the stack) are reduced. This is accomplished by avoiding a compression area relationship between the surface of the pick means and the top of the sheet stack. In particular, the pick means is placed so that it exerts a normal force only at one edge of the sheet stack from which sheets are to be picked and so that it introduces a force component that acts against the direction in which the sheet next to the top will move if a multiple pick occurs.

The present invention relates to an apparatus for removing a sheet from the top of a stack of sheets and transporting it laterally in the direction of a processing station. The apparatus comprises a pick means having an arcuate contact surface for frictionally engaging an exposed edge of the top sheet in a stack and transporting that sheet laterally at a small downward angle relative to the plane of the top of the stack. The arcuate contact surface contacts the exposed edge so that portions of the arcuate contact surface adjacent the edge extend both above and below the plane of the top of the stack. Dam means is located adjacent but spaced from the arcuate contact surface and below the plane of the top of the stack for slidingly engaging the edge of a picked sheet and the sheet surface opposite the surface engaged by the arcuate contact surface, to guide the sheet edge toward the arcuate contact surface. Retard means are mounted downstream from the dam means so as to receive the edge of sheets guided by the dam means and pinch the sheets between the retard means and the arcuate contact surface.

It is an objective of the present invention to provide an improved sheet picking mechanism.

It is another objective of the invention to provide a sheet picking mechanism that can reliably pick a single sheet from the top of a sheet stack without drawing along with it any adjacent sheet.

It is a further objective of the invention to provide a sheet picking mechanism that removes the picked sheet from the sheet stack and transports it towards a processing station, halting transport motion when the presence of more than one sheet is detected after an attempt has been made to strip off the extra sheets.

It is an additional objective of the invention to provide a sheet picking mechanism that avoids multiple picks by reducing the area in which the pick mechanism induces a frictional force between the top sheet in a stack and the sheets below it.

These and other objectives of the invention will become clear in the following detailed discussion of the preferred embodiment of the invention, including the following drawings.

DESCRIPTION OF THE PREFERRED EMBODIMENT

Figure 1:
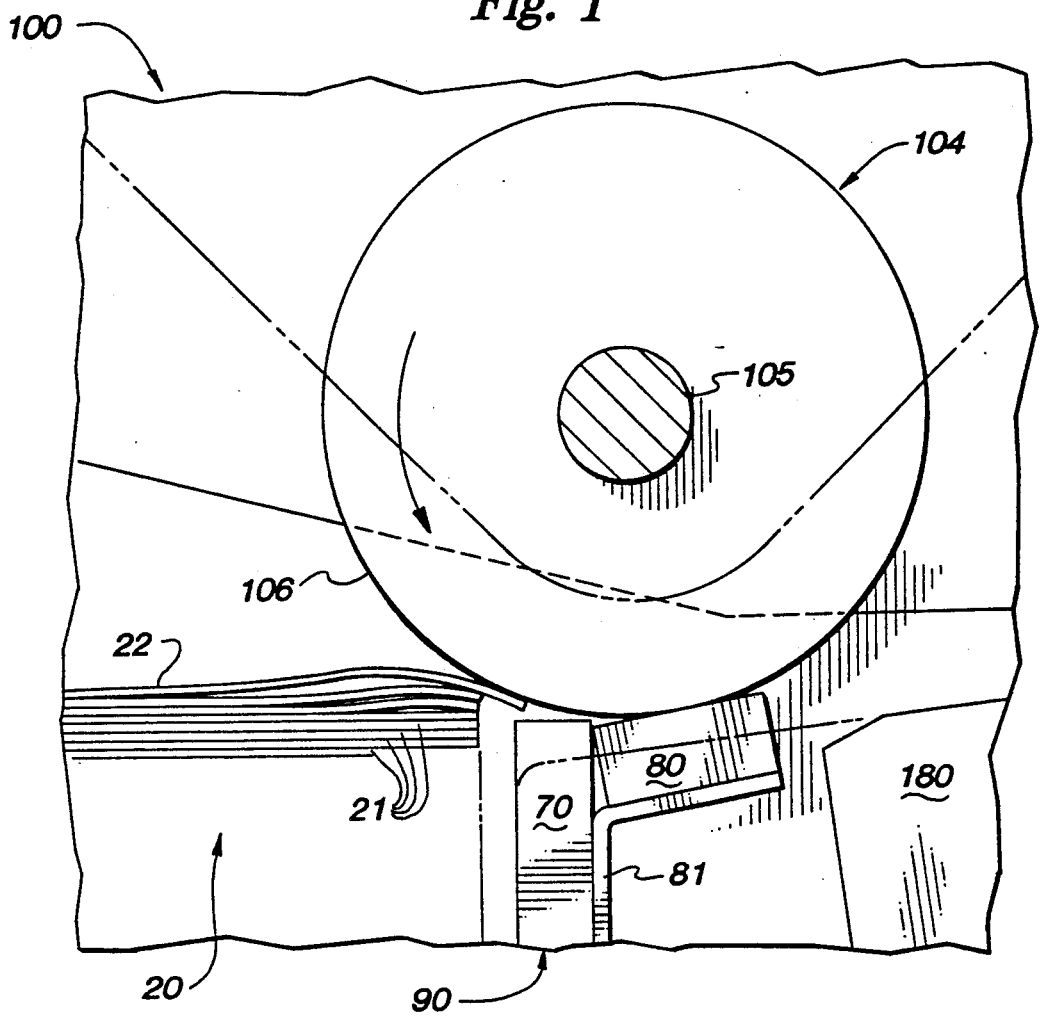
FIG. 1 is a simplified mechanical diagram of the pick mechanisn.

As seen generally in FIGS. 1, 3a–3c and 4a–4c involves a sheet picking mechanism 100 that is part of an apparatus that removes documents in sheet form from a paper stack 20 (top sheet 22 first, followed by lower sheets 21) to deliver them for transport through a processing station 200, such as an optical reader, that requires presentation of a single sheet in precise alignment. A processed sheet is further transported to an optional printing station 250 and then to a discharge hopper 270.

Figure 10:
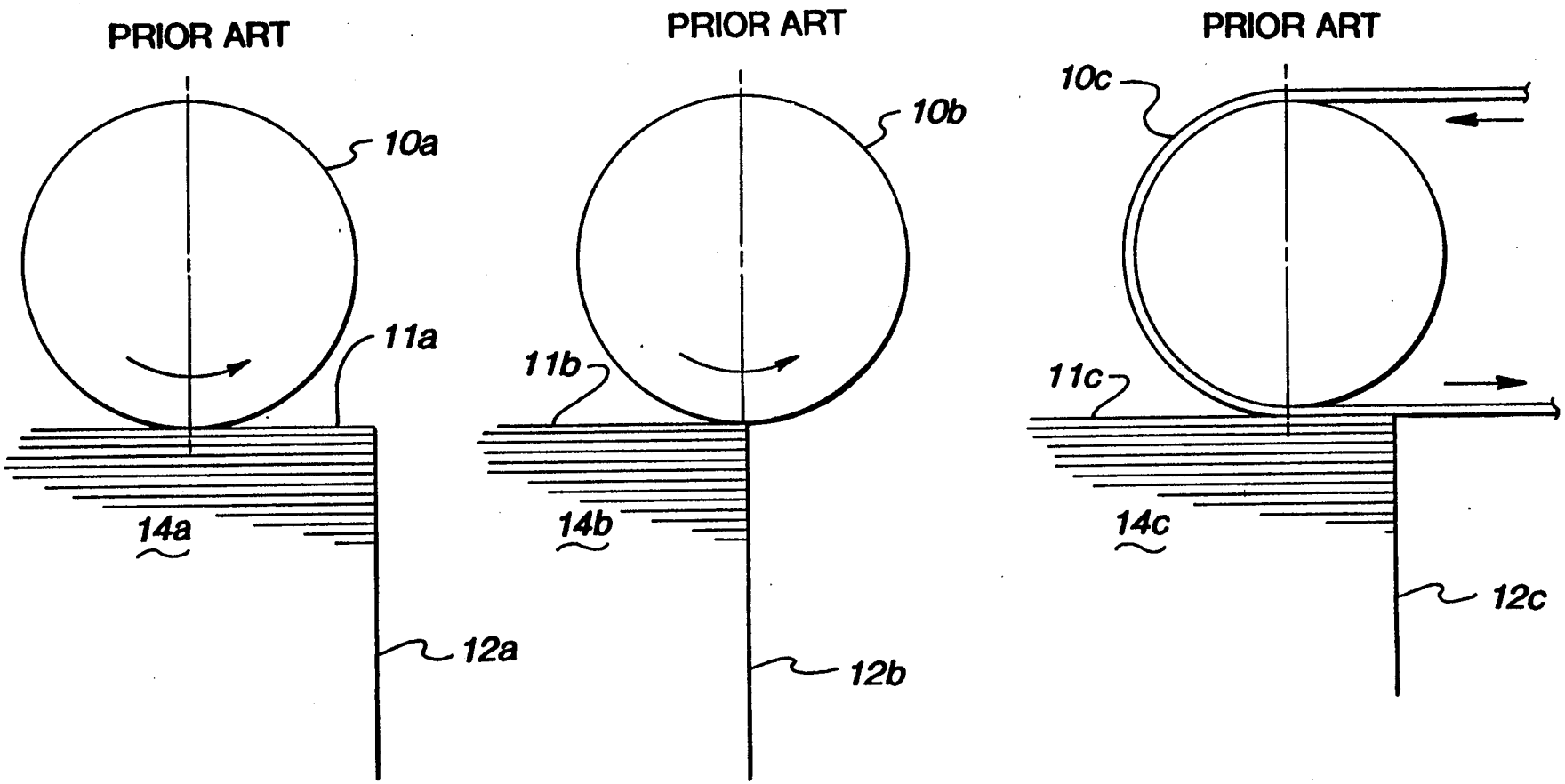
FIG. 10 is a schematic diagram showing the relationship taught by the prior art between picking rollers or belts and the stacks on which they operate.

As shown in FIG. 10, in prior art sheet picking mechanisms a roller 10a, 10b or belt 10c is conventionally used to engage the top sheet 11a, 11b or 11c in a stack 14a, 14b or 14c of sheets. The roller 10a, 10b or belt 10c has a high friction surface and its motion (as shown by arrows) draws the top sheet 11a, 11b or 11c off the top of the stack 14a, 14b or 14c. To obtain the desired frictional force, the roller 10a, 10b or belt 10c must exert a normal (vertical to the surface of sheet 11a, 11b or 11c) force on the sheet stack 12a, 12b or 12c. In the prior art the roller 10a, 10b or belt 10c has an arcuate surface that engages the surface of sheet 11a, 11b or 11c along a line of tangent contact or, in the case of belt 11c, a line of tangent contact and an adjacent area. The normal force is strongest at the line of tangency. Due to the flexibility and resilience of the paper and the surface of roller 10a, 10b or belt 10c, the force spreads into an area adjacent the line of tangency and down into the stack. In this region the top sheet 11a, 11b or 11c and the sheet next below it engage each other with frictional force and a similar relationship exists between other adjacent sheets, with decreased frictional force with greater distance from the line of tangency. It is this frictional force between adjacent sheets (which may be enhanced by the presence of stray moisture, glue, etc.) that causes the sheet (or sheets) below the top sheet to follow the top sheet when it is removed laterally. The frictional force tending to draw sheets below the top sheet along with the top sheet can be of such magnitude that separating the sheets becomes very difficult. The problem can become aggravated when the roller 10a, 10b or belt 10c, because of its location and position relative to a separator mechanism, continues to feed multiple sheets into the separator while it attempts separation.

Figure 2:
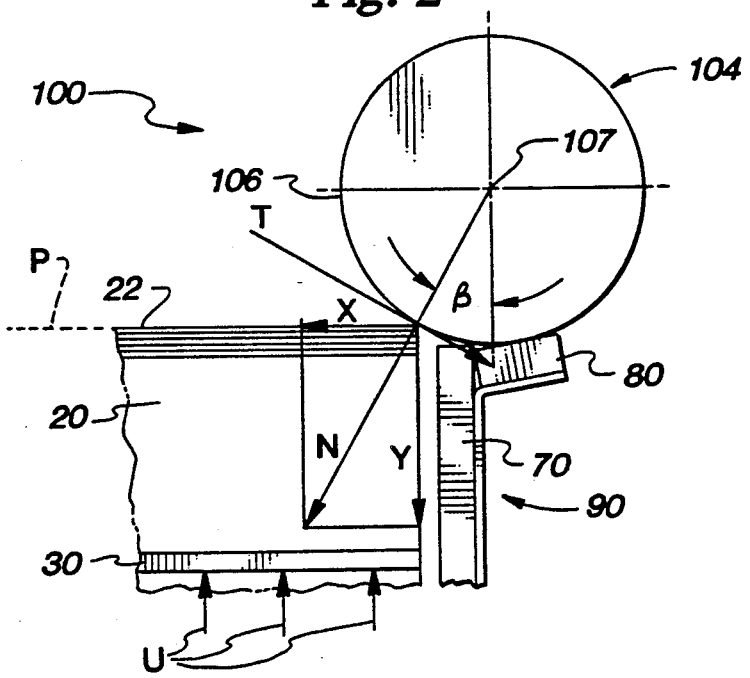
FIG. 2 is a simplified mechanical force diagram of the pick mechanism, with vectors included.

As best seen in the force diagram of FIG. 2, the present invention teaches a different relationship between the pick roller 104 and the sheet stack 20 that changes the forces exerted between sheets. In accordance with the present invention, the pick roller 104 frictionally engages an exposed edge of the top sheet 22 of a sheet stack 20 with a static force having a first, downward component (vector Y) and a second, lateral component (vector X), together forming a resultant force (vector N) that extends radially outward from the rotational axis of pick roller 104. This force is perpendicular to the dynamic force in a direction tangent to the arcuate surface of the pick roller 104 (vector T) that is exerted on the top sheet 22 when the pick roller 104 rotates counterclockwise. It should be noted that the upward force (vector U) exerted by the table 30 balances the downwardly directed force components.

The resultant force (vector N) forms an acute angle beta ($\beta$) (between about 15 and 45 degrees, preferably between 15 and 30 degrees) with the first, downward force component (vector Y), which is perpendicular to the top of the sheet stack 20 and parallel to the aligned edges of sheets in the sheet stack 20. As can be seen, the rotational axis 107 of pick roller 104 is oriented generally parallel to a picking plane P, defined as the plane of the top sheet in the sheet stack 20. This rotational axis 107 is also positioned above and spaced to the right of the plane of the aligned edges of the sheets (along vector Y) in the sheet stack 20. This positioning causes a portion of the arcuate contact surface 106 of the pick roller 104 to lie below the picking plane P while the remainder of the arcuate contact surface 106 lies above the picking plane P. Portions of the arcuate contact surface 106 on opposite sides of the line of contact between the pick roller 104 and the edge of the top sheet 22 lie above and below the picking plane P. As will be explained in greater detail below, a dam means 70 and retard means 80 located adjacent the pick roller 104 ("downstream" in terms of sheet motion) and just below the picking plane P aid in reducing the likelihood of a multiple sheet pick.

As best sign in FIG. 1, the edge of top sheet 22 is driven downward at a slight angle to follow the arcuate surface 106. The second, lateral force component causes the top sheet 22 as well as those immediately below it to bow upwardly. This also helps to reduce the friction between adjacent sheets. In fact, the sheet next below 22 is subject to a force that directly opposes the friction force tending to make it follow the sheet 22.

Although retard means 80 is provided, it should be emphasized that the first and primary aspect of the present invention that is designed to prevent multiple sheet picks is the configuration and position of the pick roller 104 relative to the top sheet 22. To summarize, the invention provides three features to avoid multiple sheet picking:

1. The top sheet 20 exerts far less frictional force on the sheet 21 next below, because it contacts the sheet 21 next below only along a line, not an area as in the prior art. (Reduction of frictional force).
2. The sheets 21 under the top sheet 22 experience a rearward force (i.e., a force opposing the frictional force tending to draw them along with the top sheet 22; see FIG. 2, vector X) that virtually cancels the forward frictional force exerted by the top sheet 22 when picking occurs. The net forward force on the next-to-the-top sheet approaches zero. (Counter-action of frictional force).

3. The small residual forward forces tending to cause a multiple sheet feed to advance are stopped by the retard means 80. (Back-up defense).

Returning now also to FIGS. 3a–3c and 4a–4c, the preferred embodiment of the invention is part of a machine for processing sheet documents by optical scanning. The sheet stack 20 rests on a table 30 that turns on a pivot axis 32. This permits the end of the table 30 nearest the picking mechanism 100 to be lifted or lowered relative to the pick roller 104. The pivot axis 32 is generally horizontal and is mounted on a frame 24 that extends the length of the sheet transport path and includes a generally vertical wall 26 on which most components are mounted. The force for pivoting the table 30 is applied by tension spring 36 anchored at one end in a tension adjustment bracket 38 and at the other end in a tag 35 at the end of pivot arm 34. The arm 34 has a bracket-mounted stud 33 near its center that rides between the tines of a fork 42. The lever arm 41 of the fork 42 is connected to a crank 44 on a gear motor 40, cooperating with a pair of limit switches 46, each of which allows the crank 44 to turn 180 degrees in one direction before switching the gear motor off. One switch senses the "down" position of the table 30; the other senses the table "up" position and its state can be used to check "ready for feed" status. When the crank 44 turns 180 degrees, the fork 42 is retracted and tension spring 36 can raise the end of the table 30 opposite the pivot axis 32 towards the pick roller 104. The tension spring 36 is selected so that whatever the angle of the table 30, the sheet stack 20 exerts a constant upward force of about 250 grams against the pick roller 104. A leaf spring 50 that contacts table 30 when it is empty serves as an empty stack sensor 52 by completing an electrical circuit. As table 30 rotates, the edges of sheets in the stack 20 travel along edge guide wall 39. A display 57 using LED or other similar alphanumeric display means is located above the table 30 on the opposite side of the frame 24 for displaying various system status messages.

The pick mechanism (or pick means) 100 comprises the pick roller 104 mounted for rotation on axle 105. The surface 106 of the pick roller 104 is arcuate, preferably cylindrical. The pick roller 104 and axle 105 are mounted on a bracket 108 that positions roller 104 relative to the sheet stack 20 in the manner described above and as shown in greater detail in FIGS. 1,2. A drive belt (not shown) that travels from a drive motor 18 along a sequence of driven rollers 54,56 (with associated idler rollers) mounted for rotation on the side of wall 26 opposite the table 30 provides rotational motion to the pick roller 104 via a spring clutch 109 that is used to selectively apply the driving force.

Just below the pick roller 104 is a guide and retard assembly 90, including dam means 70 and retard means (friction pad) 80, both of which are on an L-shaped arm 92 that pivots on a pin 93. A bracket 81 holds retard means 80. Downward motion of the arm 92 is limited by adjustable stop 94. Upward force of the guide and retard assembly 90 is provided by a tension spring 96 connected between adjustment arm 97 and anchor post 93.

The dam means 70 offers a smooth, low friction surface that slidably receives the edges of laterally and downwardly directed sheets 22, 21 from the sheet stack 20. The surface of dam means 70 is located parallel to and just below the picking plan P and also just below the pick roller 104. The dam means 70 takes a sheet 22 that is being driven downward at a slight angle by the arcuate contact surface 106 of the pick roller 104 and guides it toward the retard means 80.

Retard means 80 is angled upward to the right (as viewed in FIG. 1) at about ten degrees relative to the picking plane P. It is also positioned so that it has a tangent relationship with the arcuate contact surface 106. That is, dam means 70 guides a sheet 22 into a tapered retard gap where the sheet 22 is pinched between the static surface of retard means 80 and the moving surface of pick roller 104. To permit the retard means 80 to exert meaningful retarding friction force on a sheet that erroneously accompanies the top sheet 22 in a multiple pick, the retard means 80 has a friction surface; however, to permit a single top sheet 22 to pass without undue resistance, the coefficient of friction of the retard means 80 is significantly lower than that of the arcuate contact surface 106. It is high enough, however, to retard an extra sheet 21 traveling along with top sheet 22 in most cases. When only a single sheet is present, the primary function of the retard means 80 is to press the sheet against the pick roller 104 to supplement the frictional transport force generated at the contact line between arcuate contact surface 106 and the sheet stack 20.

The force that the retard means 80 exerts at the retard gap is about 140 grams as determined by the tension spring 96. Because the guide and retard assembly 90 can be driven downward by the impact of successive sheet picks, particularly of sheets of stiffer material, and by picking at high speeds, the stop 94 limits downward travel to keep both in operating position.

Figure 5:
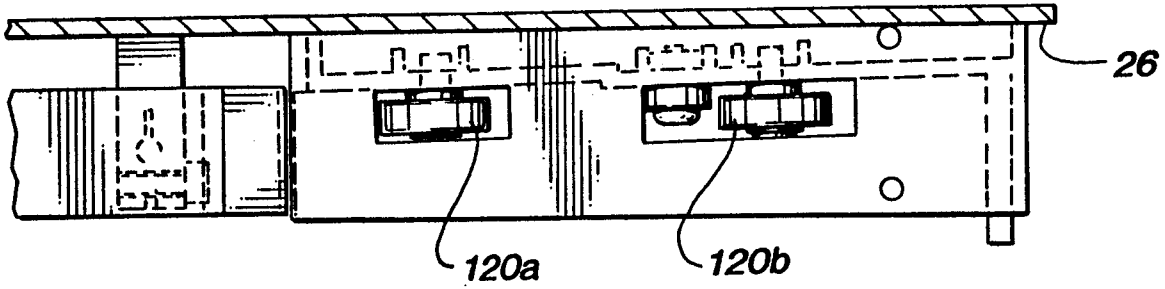
FIG. 5 is a fragmentary top plan view of the angled roller paper transport assembly located beneath the thickness sensor.

Transport of a sheet 22 that is picked and driven past the retard means 80 is accomplished by driven wheels 122a, 122b above the sheet path, with corresponding idler wheels 120a, 120b, respectively, below the sheet path. As can be seen in FIG. 5, the rollers 120a, 120b are angled slightly toward the wall 26 (about 1.5 degrees) to aid in correcting skewing of a sheet 22. The wall 26 serves as a reference surface for sheet alignment, and the angled rollers 120a, 120b force sheets against the wall 26.

Figure 7:
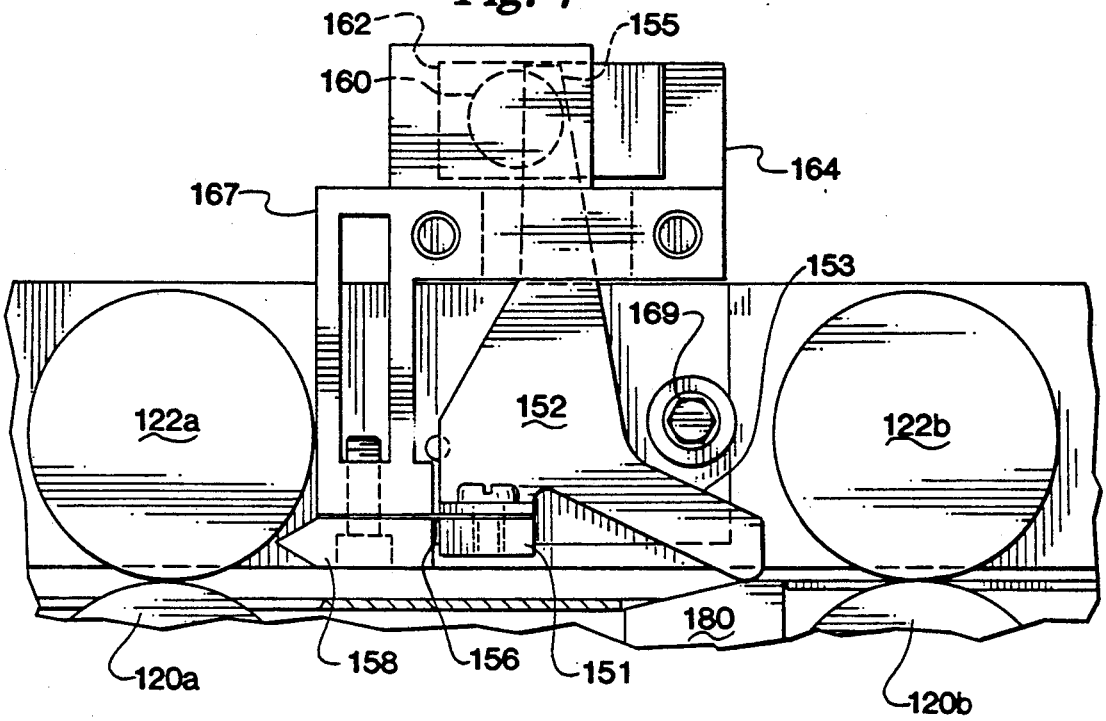
FIG. 7 is a slightly enlarged, side elevational, fragmentary view of the thickness sensor assembly.
Figure 8:
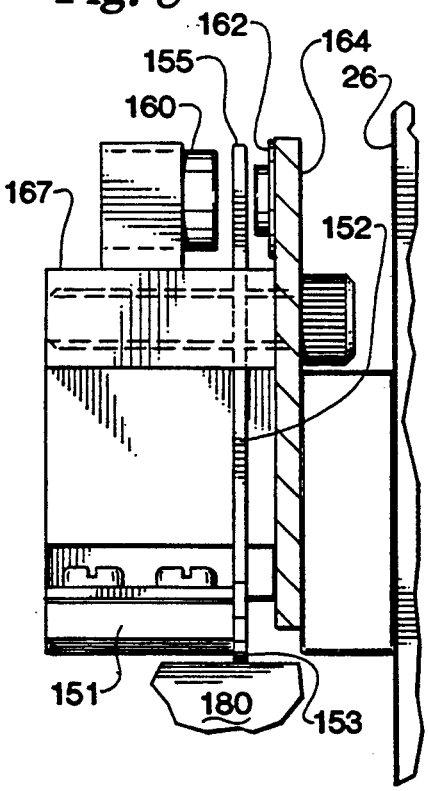
FIG. 8 is a fragmentary front elevational view of the assembly of FIG. 7.
Figure 9:
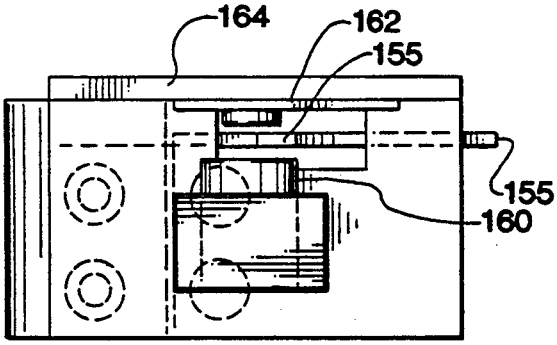
FIG. 9 is a top plan view of the assembly of FIG. 7.

Between the roller pair 120a, 122a and 120b is located a sheet thickness sensor assembly 160. As best seen in FIGS. 7—9, thickness is measured in a measuring gap between ramped base surface 180 and sensor finger 153 of sensor arm 152. Sensor arm 152 is mounted on an arm clamp assembly 151 that also holds a flex hinge 156 in the form of a leaf spring, whose opposite end is held in hinge clamp 158. This hinge arrangement permits finger 153 to be displaced upward by rotation of arm 152 in a plane perpendicular to the plane of a sheet 22 that is in the measuring gap. Motion of the arm 152 in other directions is severely limited to permit arm 152 to respond precisely to sheet thicknesses in the range from 0.0035 inches to 0.010 inches.

Above the arm clamp assembly 151 is a sensor mounting frame 167 housing a magnet 160 facing a Hall effect sensor chip 162. The frame 167 is, in turn, mounted on a mounting plate 164 attached to the wall 26 by fastener 169. The sensor chip 162 is fastened to the mounting plate 164 opposite the magnet 160 so as to form a gap between them. Interposer blade tip 155 of arm 152 is located and moves within the gap between the Hall effect sensor chip 162 and the corresponding magnet 160. When the blade tip 155 occludes various portions of the magnetic field in this gap, the output voltage from the Hall effect sensor chip 162 corresponds to the amount of displacement of sensor finger 153. If the sheet thickness sensed exceeds predefined limits, then a multiple sheet pick is indicated. An error is signaled and rotation of the pick roller 104 and transport rollers 122a, 122b is inhibited.

When the leading edge of a sheet 22 has passed through the thickness sensor assembly 150, it reaches rollers 122a, 122b and is driven into the sensing region of skew sensors 60, 62. Together these photosensors 60, 62 sense whether a transported sheet is present and aligned along the reference surface of wall 26 or is skewed away from it. Excessive skew sensed by sensor 60 leads to an error condition. If neither sensor 60, 62 senses a sheet when expected, then a jam may be present and a different error condition is registered.

Figures 3, 3A:
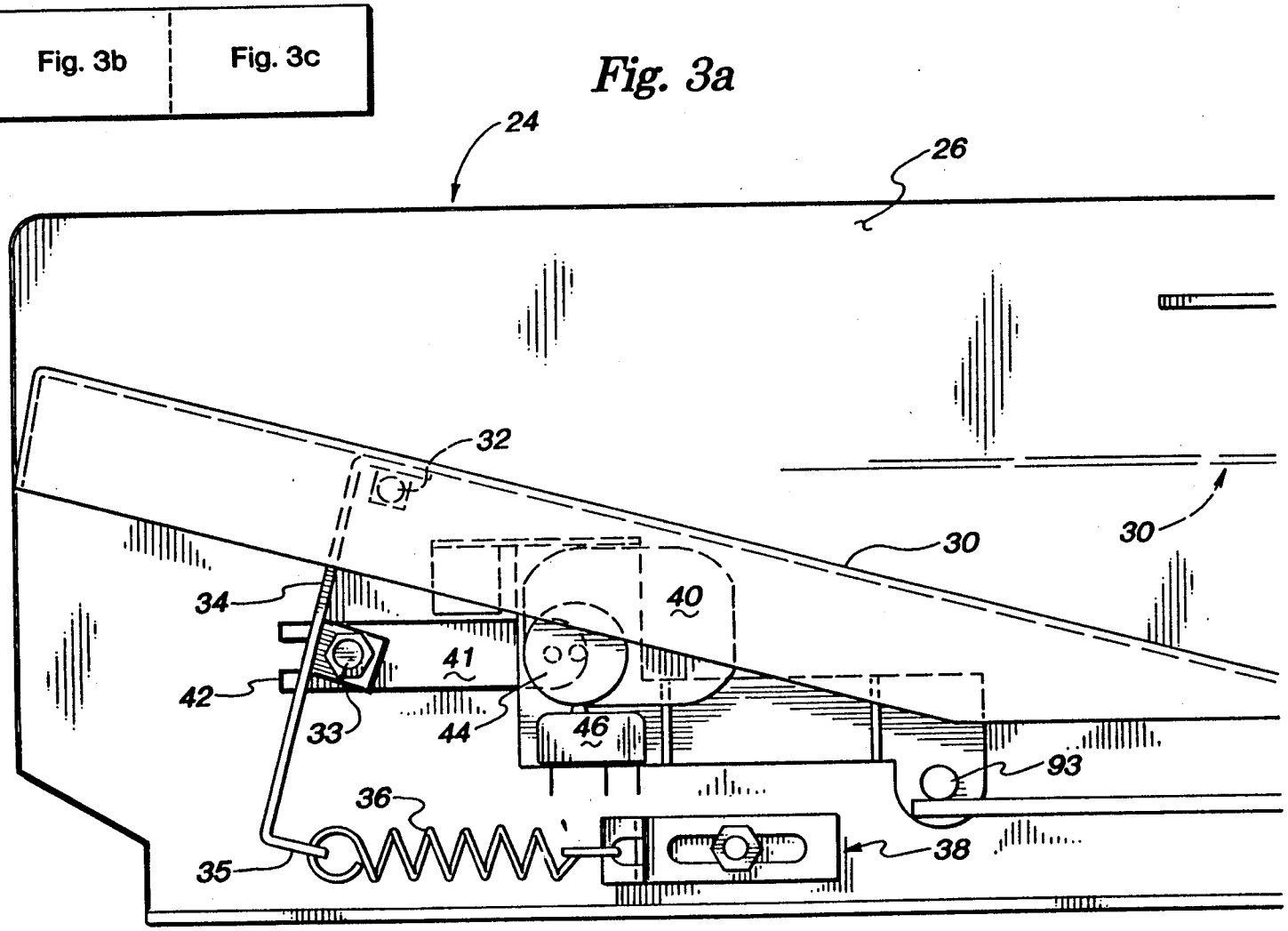
FIG. 3, 3a, 3b, and 3c (a multiple sheet figure) is a side elevational view of the pick mechanism with the surrounding paper handling mechanism assembly.
Figure 3B:
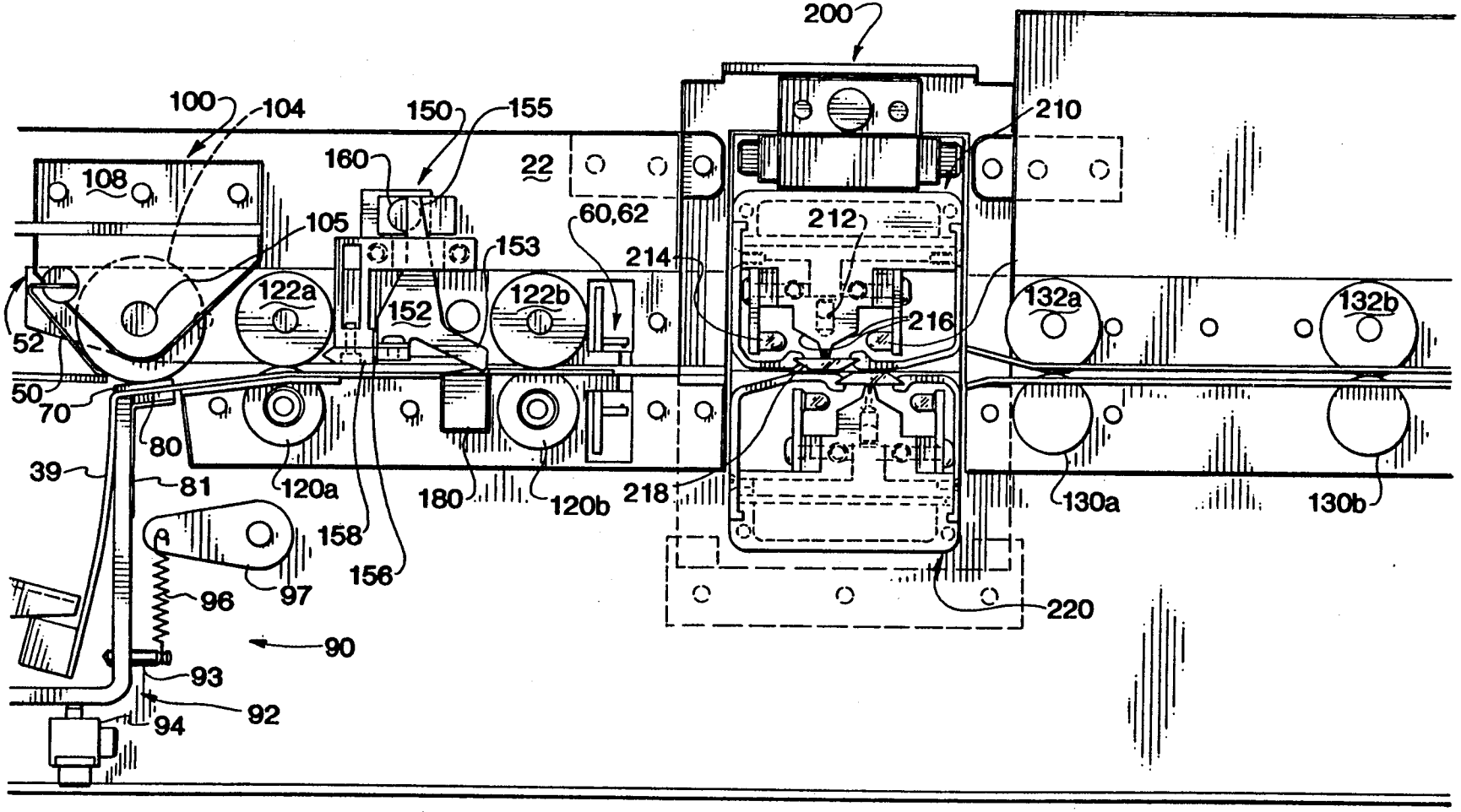
Figure 3C:
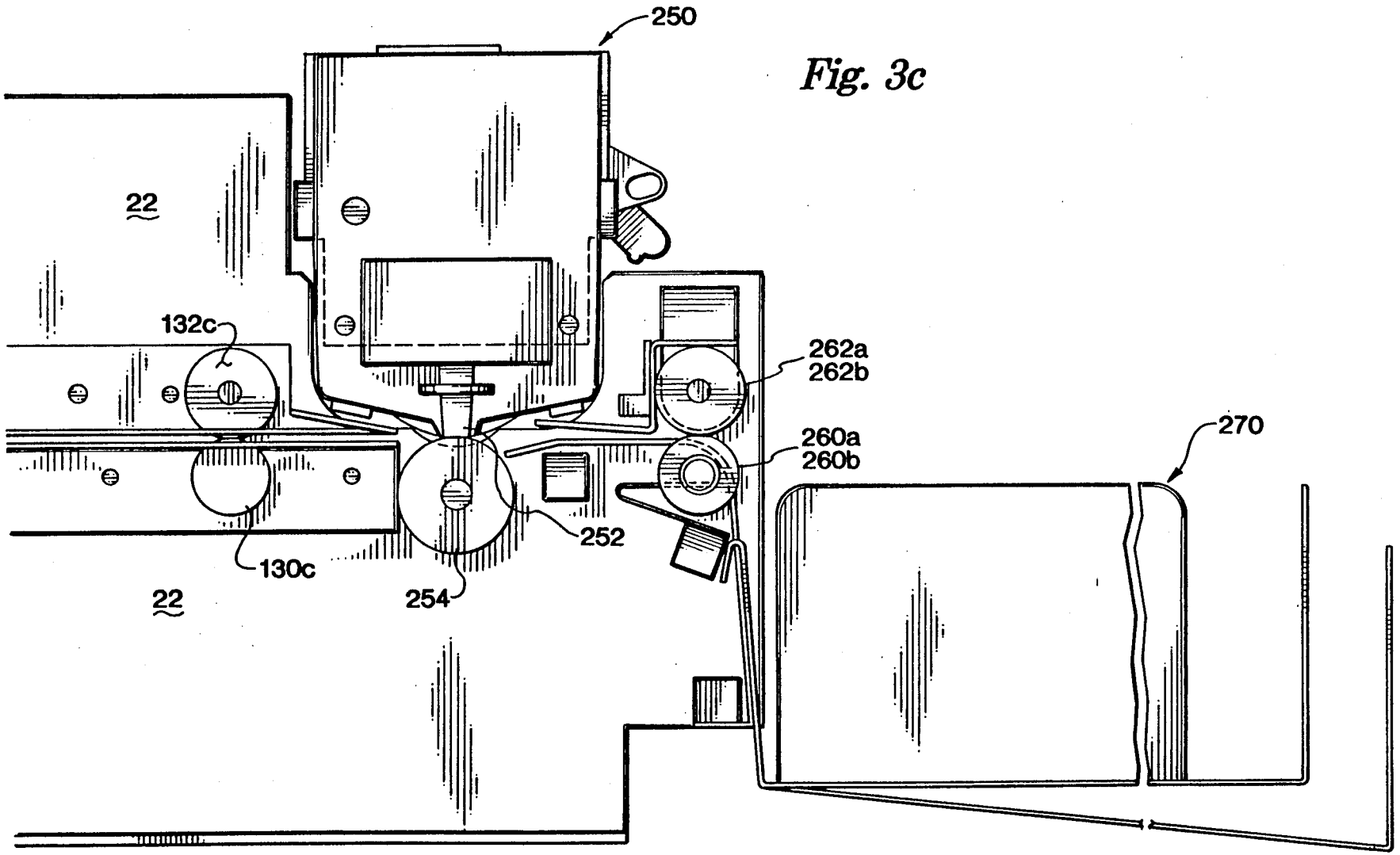
Figures 4, 4A:
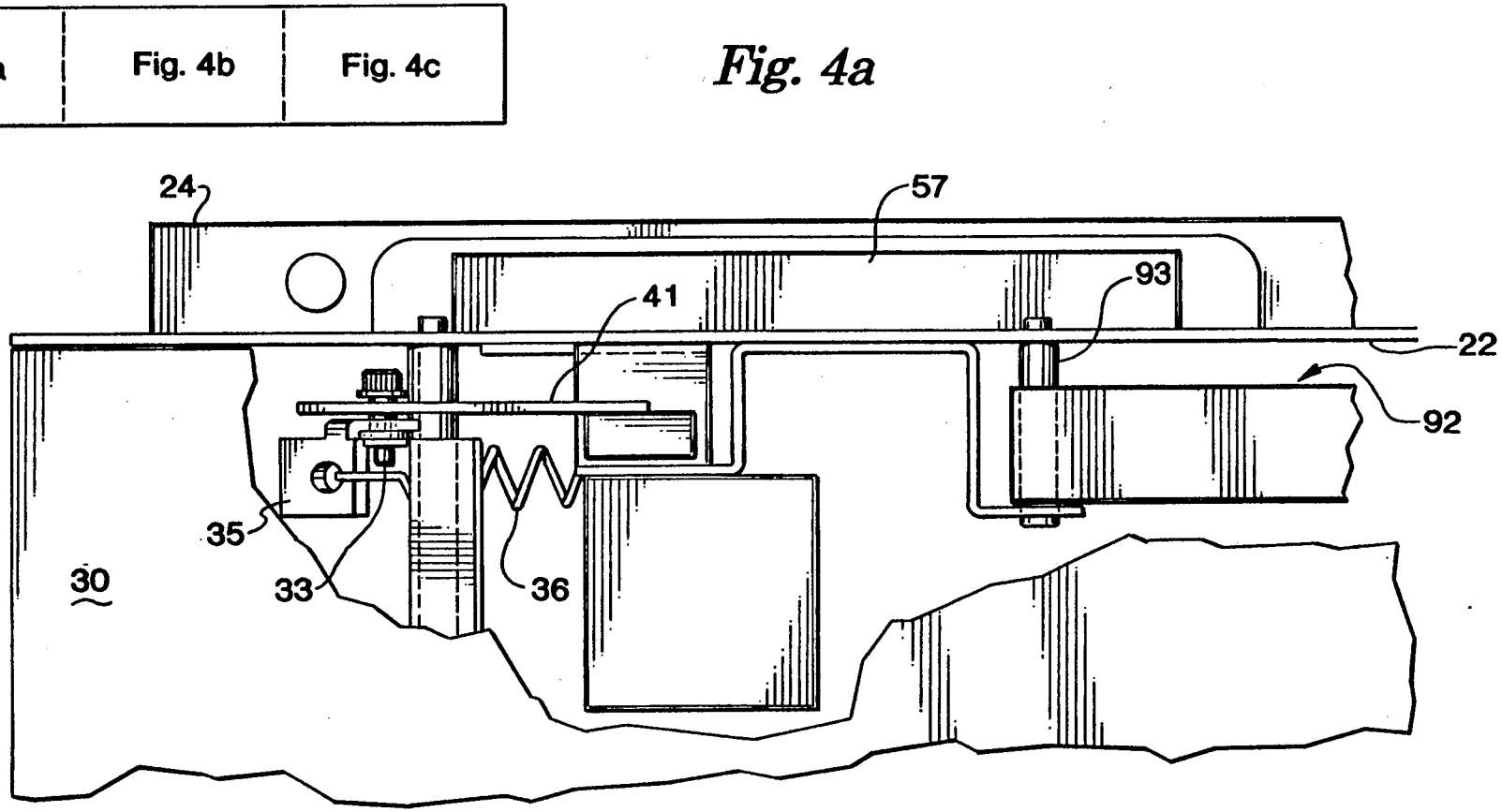
FIG. 4, 4a, 4b, and 4c (a multiple sheet figure) is a top plan view of the pick mechanism and assembly of FIG. 3 with a portion of the paper stack table cut away.
Figure 4B:
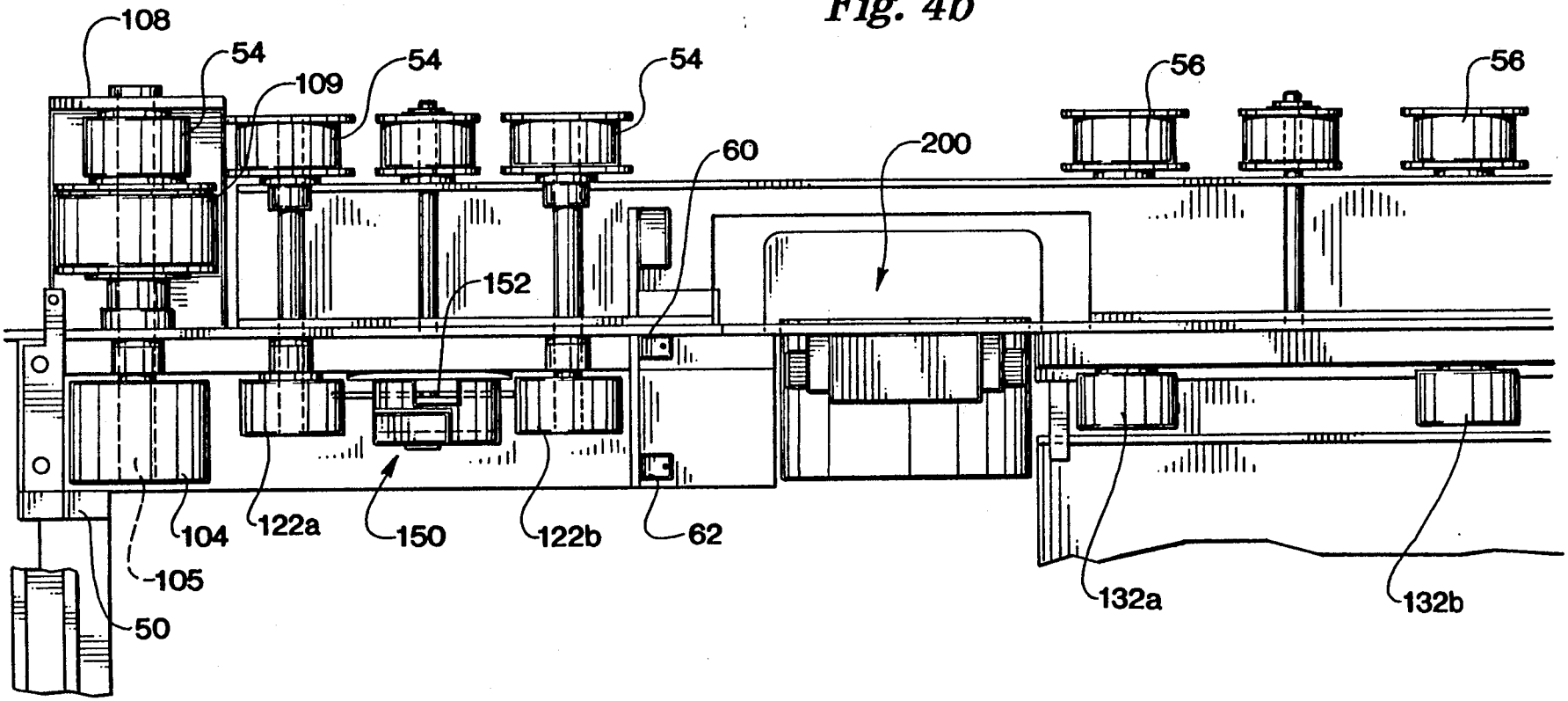
Figure 4C:
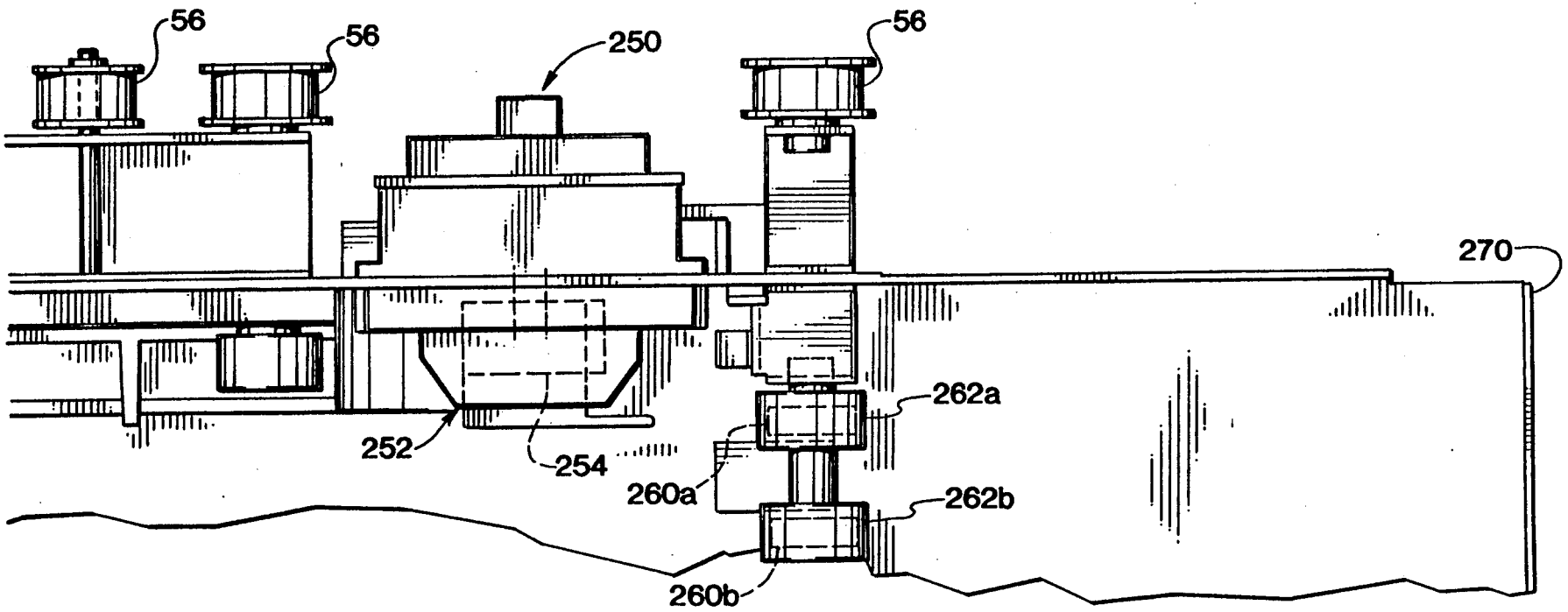

If the skew sensors 60, 62 are passed without error, then the sheet 22 proceeds to the processing station 200 where optical reading occurs. As best seen in FIG. 3b, the processing station preferably uses reflective reading techniques to sense markings on either side of a sheet; accordingly, it has an upper optical reading assembly 210 and a lower optical reading assembly 220. Each of these is based on conventional designs and includes a pair of light sources 214, each projecting light onto a mirrored surface 216 on one side of a housing for a photocell 212. The photocell 212 senses reflected light or darkness according to images transmitted from a sheet up through protective lens 218. Lower optical reader assembly 220 is identical but inverted and offset so that the upper surface and lower surface reading fields are separate. In the preferred embodiment each upper and lower optical reading assembly 210, 220 has an associated data processing means 310, 320, respectively, for control and sensor output handling purposes (see FIG. 11).

Figure 6:
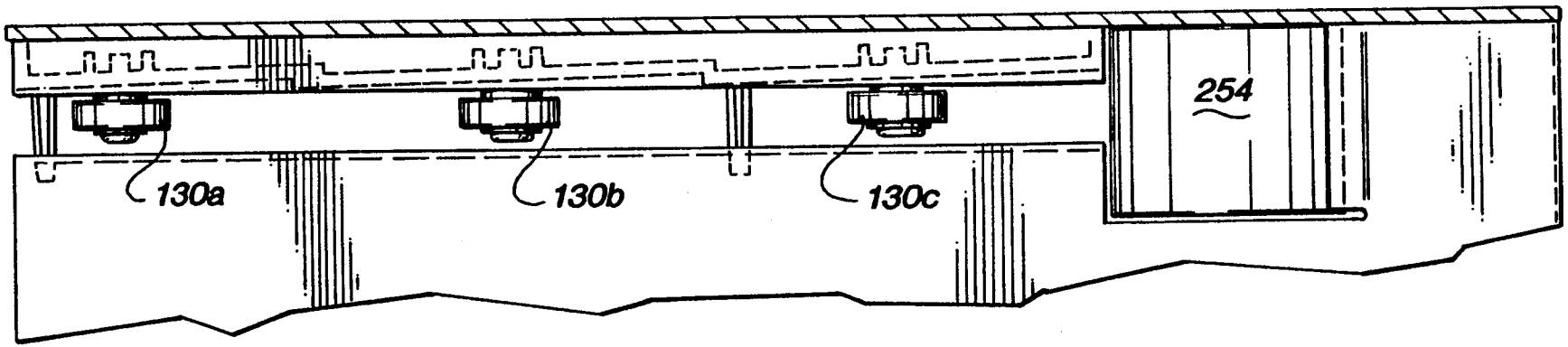
FIG. 6 is a fragmentary top plan view of the angled roller paper transport assembly located after the optical paper reading machanism and before discharge.

After passing through the processing station 200, a scanned sheet is picked up by driver rollers 132a, 132b, 132c above the sheet path and their corresponding idler rollers 130a, 130b, 130c below the sheet path. As seen in FIG. 6, the rollers 130a, 130b, 130c are angled slightly to aid in holding the sheet 22 against the reference surface formed by wall 26. To help hold a sheet 22 taut and flat during optical scanning the drive pulleys 56 for rollers 132a, 132c have fewer teeth than the drive pulleys 54 so that rollers 13a, 132c are driven slightly faster than the rollers 122a, 122b.

After leaving the roller pair 130c, 132c the sheet 22 enters the print station 250 where an optional print head 252 opposed by a print roller 254 is used to print a score or any desired information on the sheet 22. After exiting from the print station 250, the sheet 22 is grasped by a pair of driven upper discharge rollers 262a, 262b, and corresponding idler 260a, 260b. These rollers drive the sheet into discharge hopper 270.

CONTROL SYSTEM AND OPERATION

Figure 11:
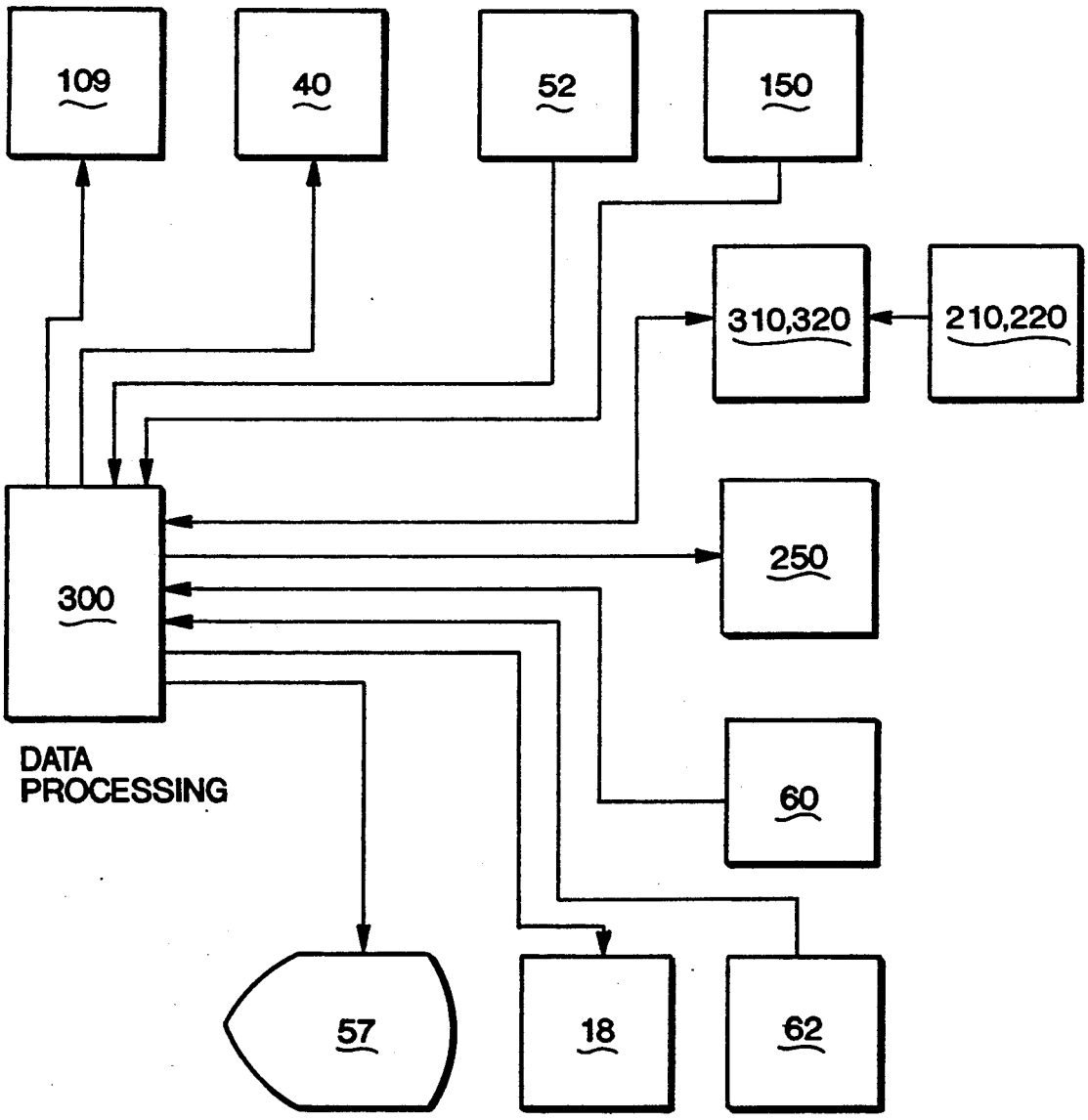
FIG. 11 is a block diagram showing the connections between various components of the control system for the present invention.

FIG. 11 shows in block diagram form the elements of a control system for the present invention. At the heart of the control system is a digital data processing means 300 (preferably a Zylog Super 8-8K microprocessor) that is programmed to receive various input signals and issued control signals as described next.

When the system of the present invention is turned on, the data processing means 300 first issues a signal to gear motor 40 to retract arm 41 to allow spring 36 to raise table 30 against the pick roller 104. The empty stack sensor 52 is polled to see if the table 30 is empty. If so, the system enters a wait state, which it makes known with a message on display 57. If sheets are present on the table 30, then an operator-initiated picking command can be issued by data processing means 300. This causes a control signal to issue to the clutch 109 for the pick roller 104. Engagement of the clutch 109 causes the pick roller 104 to turn counterclockwise (as seen in FIG. 1). This results in sheet 22 being drawn into contact with dam means 70, which guides the edge of sheet 22 into the retard gap between retard means 80 and the surface 106 above it.

If only a single sheet is present, the lesser frictional force on the sheet surface contacted by retard means 80 is overcome by the greater frictional force applied by the pick roller 104 and the sheet 22 is driven past the retard means 80. If more than one sheet is present, then the frictional force from retard means 80 is usually enough to separate the extra sheets from the top sheet 22. The sheet (or sheets, if the retard means 80 has not succeeded) will proceed toward and be grasped by roller pair 120a, 122a and driven into the measuring gap between base surface 180 and measuring finger 153. This results in a voltage signal being issued from the Hall effect chip 162 of thickness sensor assembly 150 to the data processing means 300. This voltage signal is indicative of the thickness sensed. Depending on the sheet thickness expected (which can be established by programming or a calibration run of a single sample sheet), the data processing means will let sheet transport continue or register a multiple sheet condition. This causes the action of the transport rollers to be inhibited, by a signal sent to the drive motor 18 and the error condition is registered on display 57.

Once the thickness sensor assembly 150 has allowed the sheet 22 to progress, it is grasped by roller pair 120b, 122b and driven toward skew photosensors 60, 62. If photosensor 62 senses a sheet and photosensor 60 senses no sheet, a skew condition is present that has not been corrected by the angled rollers. Because a skewed sheet can lead to inaccurate reading, an error condition is noted, an error message registered on display 57 and drive motor 18 is inhibited. If neither sensor 60 nor sensor 62 detects a sheet when expected (time out condition), a jam may have occurred. Again, an error message will be registered on display 57.

The pick roller 104 remains powered until the leading edge of sheet 22 has just passed the roller pair 120b, 122b. At this position, the power to the clutch 109 is turned off and the sheet 22 is moved downstream by the rollers 120a, 122a and 120b, 122b. As the picked sheet 22 proceeds, it will also turn the pick wheel 104, because the latter is now freewheeling. As the trailing edge of the picked sheet 22 falls over the leading edge of the sheet 21 next below it, the new leading edge (of the formerly next-to-top sheet) is exposed to the action of the still rotating pick roller 104. The sheet 21 will follow the trailing edge of sheet 22 with only a small gap between them, but it will follow only as long as the pick roller 104 is rotated. When the trailing edge of the picked sheet 22 loses contact with the pick roller 104 as it exits the retard gap, the leading edge of the sheet 21 will just be at the entry to the retard gap. Thus, it will be seen that the retard means 80 in a normal, successful pick plays an important role in a pre-pick cycle. The retard means 80 helps keep the pick roller 104 rolling while freewheeling but allows the sheet 21 to advance only to the point where it just enters the retard gap. When the next pick cycle starts the sheet 21 will start up from this position.

If a single sheet 22 is present at the thickness sensor assembly 150 and not skewed, it is driven into processing station 200 where optical reading occurs. Upper and lower optical reading assemblies 210, 220 register reflected light or the presence of marks and communicate sensed data via their local data processing means 310, 320 (preferably Zylog Super 8-8K microprocessors) to the data processing means 300, which may process this data in some fashion, as by comparing data to an answer key and developing a score and/or summing data to develop certain totals. After passing through optical processing station 200, the sheet 22 is transported by roller pairs 130*a*, 132*a*, 130*b*, 132*b*, 130*c*, 132*c* to print station 250, where a score, a total or other data may be printed on the sheet 22 under control of the data processing means 300. After passing the print station 250, the rollers 260*a*, 260*b*, 262*a*, 262*b* grasp the sheet and propel it into the discharge hopper 270.

It will be seen by those skilled in the art that various changes may be made without departing from the spirit and scope of the invention. For example, it will be clear that the invention could be implemented with other forms of pick means having different arcuate surfaces and that other means of supporting the sheet stack 20 for lifting into contact with the pick means could be utilized. In addition, it will be seen that other forms of the guide and retard assembly 90 could be used, such as dam means or retard means with a slightly different surface shape or orientation, as long as a retard gap is formed. Accordingly, the invention is not limited to what is shown in the drawings and described in the specification but only as indicated in the appended claims.

What is claim as new and desired to be protected by Letters Patent is:

1. An apparatus for removing a single, top sheet of material from a stack of sheet material comprising:

means for supporting said stack of sheet material so that prior to removal and transport of any sheet the sheets lie substantially flat and parallel to each other with at least one edge of each stacked sheet substantially aligned with one edge of the other stacked sheets, said aligned edges defining a sheet edge plane;

rotatable pick means for frictionally engaging and removing the top sheet of said stacked sheets, the rotational axis of said pick means being oriented generally parallel to said sheet edge plane and being positioned in front of and spaced from said sheet edge plane such that a plane containing said rotational axis and oriented parallel to said sheet edge plane does not pass through the stack of sheet material;

a frictional retard surface located adjacent and tangent to said pick means and in front of the sheet edge plane, said retard surface and the periphery of said pick means forming a tapered retard gap into which each sheet removed from the stack is drawn;

a low-friction guide means located between the at least one edge of said top sheet and the retard surface for receiving said at least one edge of sheets as they are drawn from the stack by the pick means and guiding the sheets into the retard gap; and means for selectively rotating pick means so that its peripheral motion draws sheets from the stack toward the guide means.

2. An apparatus for removing a sheet from the top of a stack of sheets and transporting it laterally in the direction of the processing station comprising:

means for supporting said stack of sheets so that prior to removal and transport of any sheet, the sheets lie substantially flat and parallel to each other with at least one edge of each sheet substantially aligned with one edge of the other sheets, said aligned edges defining a sheet edge plane;

pick means having an arcuate contact surface for frictionally engaging an exposed edge of the top sheet at all levels of stack depletion, said arcuate surface engaging said top sheet with a static force having a first downward component parallel to the sheet edge plane and a second, lateral component perpendicular to the sheet edge plane and opposite to the direction of transport; and dam means located adjacent but spaced from the arcuate contact surface and in front of the sheet edge plane for slidingly engaging the edge of a removed sheet and the sheet surface opposite the surface engaged by the arcuate contact surface to guide the sheet edge toward the arcuate contact surface.

3. The apparatus recited in claim 2 further comprising retard means for receiving the edge of sheets guided by the dam means and for pinching the sheets between the retard means and the arcuate contact surface.

4. The apparatus recited in claim 3 wherein said pick means for frictionally engaging the exposed surface of the top sheet is a rotation roller.

5. The apparatus as recited in claim 4 wherein said rotating roller is mounted for selective rotation while in contact with the exposed edge of the top of a stack of sheets in response to a pick command from a data processing means.

6. The apparatus recited in claim 3 wherein the retard means comprises a substantially flat friction pad of material having a lower coefficient of friction than the arcuate contact surface.

7. The apparatus recited in claim 3 further comprising a sheet thickness sensor means downstream from said retard means for sensing the thickness of sheets that are transported past said retard means.

8. The apparatus as recited in claim 7 further comprising error indicator means responsive to said thickness sensor means for signalling an error condition if a predefined sheet thickness is exceeded by the sheets transported past said retard means.

9. The apparatus as recited in claim 7 further comprising skew detection means downstream from said thickness sensor means for detecting skew of transported sheets.

10. The apparatus as recited in claim 7 wherein said pick means is a rotating roller and further comprising means responsive to said thickness sensor means for inhibiting motion of said rotating roller if a predefined sheet thickness is exceeded by the sheets transported past said retard means.

11. The apparatus as recited in claim 3 further comprising means for sensing the presence or absence of a stack of sheets.

12. The apparatus as recited in claim 3 wherein said retard means is a substantially flat friction pad spring-biased to remain in a position of substantial tangential engagement with the arcuate contact surface of the pick means just downstream from the dam means.

13. The apparatus as recited in claim 12 wherein the retard means is spring biased against the arcuate contact surface with a force of about 140 grams.

14. The apparatus as recited in claim 7 wherein said sheet thickness sensor means comprises:

a base surface;

a movable arm having a contact tip adjacent the base surface, said contact tip and base surface together defining a measuring gap;

mounting means for mounting the movable arm for displacement when one or more sheets enters the measuring gap; and means responsive to displacement of said movable arm for registering as an electrical signal the amount of deflection of said movable arm.

15. The apparatus as recited in claim 14 wherein said mounting means comprises a flex hinge mechanism that permits the arm to rotate in a single plane substantially vertical to the plane of sheets in the measuring gap but otherwise constrains movement of the arm.

16. The apparatus as recited in claim 14 wherein a portion of the arm moves in a gap between a magnet and a Hall effect sensor to produce from said Hall effect sensor a voltage dependent on the location of the arm in the gap between said magnet and said Hall effect sensor.

17. The apparatus as recited in claim 3 further comprising:

stack holder means for holding the stack of sheets on which the pick means operates; and lift means operably connected to said stack holder means for urging said stack holder means against the pick means so that the exposed edge of the top sheet of said stack engages said pick means with a force of substantially constant magnitude regardless of stack height.

18. The apparatus as recited in claim 17 wherein said force exerted by said lift means against the pick means is approximately 250 grams.

19. The apparatus as recited in claim 17 wherein the stack holder means comprises a tray mounted to rotate on an axis near an edge of the tray and the lift means comprises a bias spring of a selected spring rate connected to said tray that rotates the tray on its axis and determines the force exerted against said pick means by the top sheet of the stack.

* * * * *